United States Patent [19]

Tanner et al.

[11] 4,050,931

[45] * Sept. 27, 1977

[54] AMORPHOUS METAL ALLOYS IN THE BERYLLIUM-TITANIUM-ZIRCONIUM SYSTEM

[75] Inventors: Lee Elliot Tanner, Summit; Ranjan Ray, Morristown, both of N.J.; Carl F. Cline, Walnut Creek, Calif.

[73] Assignee: Allied Chemical Corporation, Morris Township, N.J.

[ * ] Notice: The portion of the term of this patent subsequent to Nov. 2, 1993, has been disclaimed.

[21] Appl. No.: 709,028

[22] Filed: July 27, 1976

Related U.S. Application Data

[63] Continuation-in-part of Ser. No. 604,510, Aug. 13, 1975, abandoned, which is a continuation-in-part of Ser. No. 572,563, April 28, 1975, Pat. No. 3,987,517, which is a continuation-in-part of Ser. No. 519,394, Oct. 30, 1974, abandoned.

[51] Int. Cl.[2] ..... C22C 14/00; C22C 16/00

[52] U.S. Cl. ..... 75/175.5; 75/134 N; 75/177

[58] Field of Search ..... 75/175.5, 176, 177, 75/150, 134 N

[56] References Cited

U.S. PATENT DOCUMENTS 3,856,513 12/1974 Chen et al. ..... 75/122

3,989,517 11/1976 Tanner et al. ..... 75/175.5

*Primary Examiner*—Arthur J. Steiner

*Attorney, Agent, or Firm*—David W. Collins; Gerhard H. Fuchs

[57] ABSTRACT

Amorphous metal alloys are prepared from compositions in the beryllium-titanium-zirconium system. The compositions, in the form of long, continuous ribbon, are defined within an area on a ternary diagram having as its coordinates in atom percent beryllium, atom percent titanium, and atom percent zirconium, the area being defined by a polygon having at its corners the 10 points defined by a. 40% Be, 58% Ti, 2% Zr
b. 35% Be, 57% Ti, 8% Zr
c. 30% Be, 55% Ti, 15% Zr
d. 30% Be, 20% Ti, 50% Zr
e. 35% Be, 0% Ti, 65% Zr
f. 45% Be, 0% Ti, 55% Zr
g. 55% Be, 15% Ti, 30% Zr
h. 55% Be, 20% Ti, 25% Zr
i. 50% Be, 35% Ti, 15% Zr
j. 43% Be, 53% Ti, 4% Zr.

These alloys evidence high strength, low density, a specific strength of at least about 33 × $10^5$ cm and good ductility. The alloys are useful in applications requiring a high strength-to-weight ratio.

5 Claims, 1 Drawing Figure

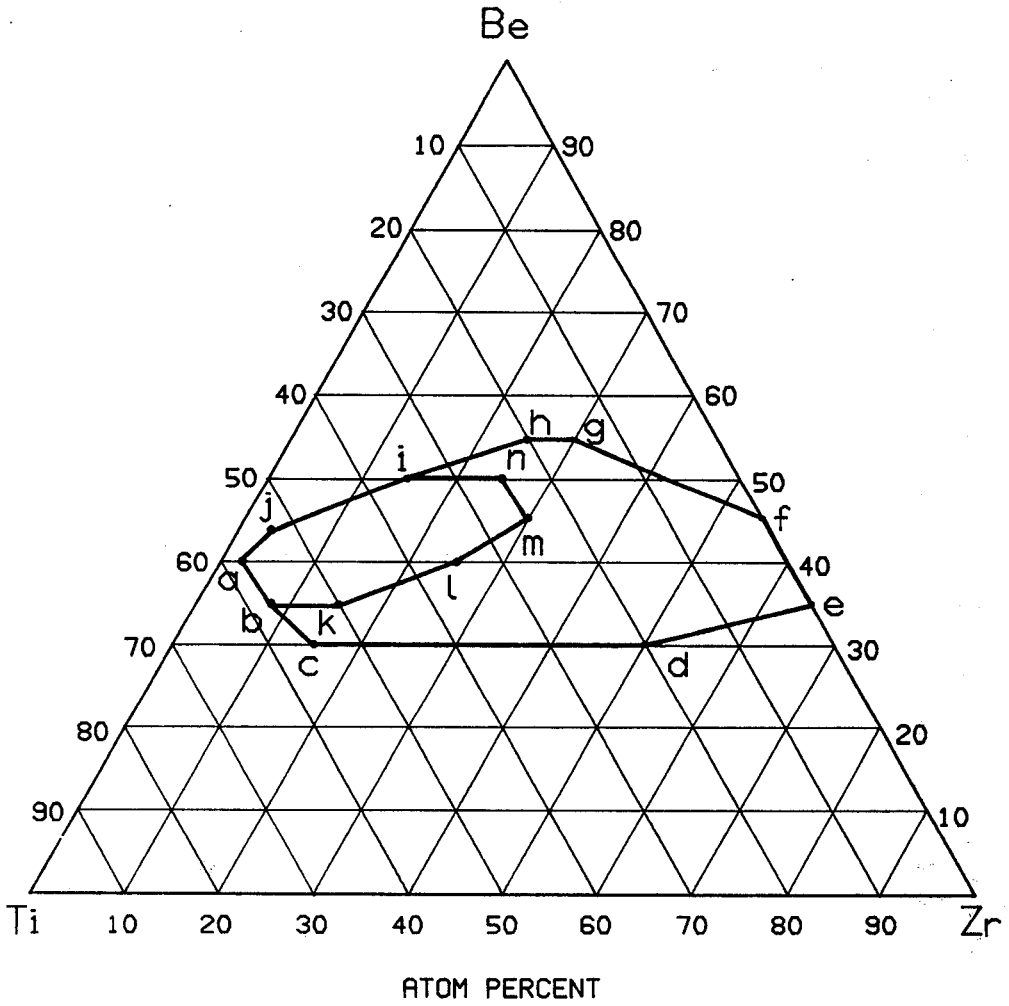
Be
Ti
Zr
10
20
30
40
50
60
70
80
90
a
b
c
d
e
f
g
h
i
j
k
l
m
n
ATOM PERCENT

AMORPHOUS METAL ALLOYS IN THE BERYLLIUM-TITANIUM-ZIRCONIUM SYSTEM

This is a continuation-in-part of application Ser. No. 604,510, filed Aug. 13, 1975, now abandoned, which is a continuation-in-part of application Ser. No. 572,563, filed Apr. 28, 1975, now U.S. Pat. No. 3,987,517, issued Nov. 2, 1976, which is a continuation-in-part of Ser. No. 519,394, filed Oct. 30, 1974 and now abandoned.

BACKGROUND OF THE INVENTION

1. Field of the Invention

This invention relates to amorphous metal alloys, and, more particularly, to high strength, low density compositions in the beryllium-titanium-zirconium system.

2. Description of the Prior Art

Investigations have demonstrated that it is possible to obtain solid amorphous materials from certain metal alloy compositions. An amorphous material substantially lacks any long range order and is characterized by an X-ray diffraction profile in which intensity varies slowly with diffraction angle. Such a profile is qualitatively similar to the diffraction profile of a liquid or ordinary window glass. This is in contrast to a crystalline material which produces a diffraction profile in which intensity varies rapidly with diffraction angle.

These amorphous metals exist in a metastable state. Upon heating to a sufficiently high temperature, they crystallize with evolution of heat of crystallization, and the X-ray diffraction profile changes from one having amorphous characteristics to one having crystalline characteristics.

Novel amorphous metal alloys have been disclosed and claimed by H. S. Chen and D. E. Polk in U.S. Pat. No. 3,856,513, issued Dec. 24, 1974. These amorphous alloys have the formula $M_aY_bZ_c$ where M is at least one metal selected from the group of iron, nickel, cobalt, chromium and vanadium, Y is at least one element selected from the group consisting of phosphorus, boron and carbon, Z is at least one element selected from the group consisting of aluminum, antimony, beryllium, germanium, indium, tin and silicon, "*a*" ranges from about 60 to 90 atom percent, "*b*" ranges from about 10 to 30 atom percent and "*c*" ranges from about 0.1 to 15 atom percent. These amorphous alloys have been found suitable for a wide variety of applications, including ribbon, sheet, wire, powder, etc. Amorphous alloys are also disclosed and claimed having the formula $T_iX_j$, where T is at least one transition metal, X is at least one element selected from the group consisting of aluminum, antimony, beryllium, boron, germanium, carbon, indium, phosphorus, silicon aand tin, "*i*" ranges from about 70 to 87 atom percent and "*j*" ranges from about 13 to 30 atom percent. These amorphous alloys have been found suitable for wire applications.

At the time these amorphous alloys were discovered, they evidenced mechanical properties that were superior to then known polycrystalline alloys. Such superior mechanical properties included ultimate tensile strengths of up to 350,000 psi, hardness values (DPH) of about 650 to 750 kg/mm and good ductility. Nevertheless, new applications requiring improved magnetic, physical and mechanical properties and higher thermal stability have necessitated efforts to develop further compositions. More specifically, there remains a need for high strength, low density material suitable for structural applications.

SUMMARY OF THE INVENTION

In accordance with the invention, high strength, low density amorphous metal alloys are formed from compositions defined within an area on a ternary diagram, having as its coordinates in atom percent Be, atom percent Ti and atom percent Zr, the area being defined by a polygon having at its corners the 10 points defined by a. 40% Be, 58% Ti, 2% Zr
b. 35% Be, 57% Ti, 8% Zr
c. 30% Be, 55% Ti, 15% Zr
d. 30% Be, 20% Ti, 50% Zr
e. 35% Be, 0% Ti, 65% Zr
f. 45% Be, 0% Ti, 55% Zr
g. 55% Be, 15% Ti, 30% Zr
h. 55% Be, 20% Ti, 25% Zr
i. 50% Be, 35% Ti, 15% Zr
j. 43% Be, 53% Ti, 4% Zr.

Such alloys evidence specific strengths of at least about $33 \times 10^5$ cm.

Preferably, the amorphous metal alloys of this invention are formed from compositions defined within an area on the Be-Ti-Zr ternary diagram represented by a polygon having at its corners the eight points defined by a. 40% Be, 58% Ti, 2% Zr
b. 35% Be, 57% Ti, 8% Zr
k. 35% Be, 50% Ti, 15% Zr
l. 40% Be, 35% Ti, 25% Zr
m. 45% Be, 25% Ti, 30% Zr
n. 50% Be, 25% Ti, 25% Zr
i. 50% Be, 35% Ti, 15% Zr
j. 43% Be, 53% Ti, 4% Zr.

Such alloys evidence specific strengths of at least about $45 \times 10^5$ cm.

Also, preferably, the amorphous metal alloys of this invention are formed from compositions represented by the formula $Be_{40}Ti_{60-x}Zr_x$, where "*x*" ranges from about 2 to 30 atom percent. Such alloys combine high specific strengths ranging from about $45 \times 10^5$ to $60 \times 10^5$ cm, ease of fabricability and high ductility.

The alloys of this invention are at least 50% amorphous, and preferably substantially amorphous, that is, at least 80% amorphous, and most preferably about 100% amorphous, as determined by X-ray diffraction.

The amorphous metal alloys are fabricated by a process which comprises forming a melt of the desired composition and quenching at a rate of at least about $10^{5°}$ C/sec by casting molten alloy onto a rapidly rotating chill wheel in an inert atmosphere or in a partial vacuum.

BRIEF DESCRIPTION OF THE DRAWING

The FIGURE is a ternary phase diagram in atom percent of the system Be-Ti-Zr, depicting the glass-forming region.

DETAILED DESCRIPTION OF THE INVENTION

Composites typically comprise filaments embedded in a matrix. In order to obtain high strength, low density composites, it is important that the filaments also have high strength and low density. The specific strength of a material is a convenient measure of the strength-to-weight ratio, and permits comparison of different filament materials. The higher the specific strength of a material, the more likely it will find potential use as composite reinforcement.

The specific strength of amorphous metal alloys is calculated by dividing the hardness value (in kg/mm$^2$) by both 'a dimensionless factor of about 3.2 and the density (in g/cm$^3$). The basis for the dimensionless factor is given in Scripta Metallurgica, Vol. 9, pp. 431–436 (1975). Examples of specific strengths of prior art amorphous metal alloys include 15.1 $\times$ 10$^5$ cm for $Pd_{80}Si_{20}$ and 29.6 $\times$ 10$^5$ cm for $Ti_{50}Cu_{50}$.

In accordance with the invention, high strength, low density amorphous metal alloys are formed from compositions defined within an area on a ternary diagram having as its coordinates in atom percent Be, atom percent Ti and atom percent Zr, the area being defined by a polygon having at its corners the 10 points defined by a. 40% Be, 58% Ti, 2% Zr
b. 35% Be, 57% Ti, 8% Zr
c. 30% Be, 55% Ti, 15% Zr
d. 30% Be, 20% Ti, 50% Zr
e. 35% Be, 0% Ti, 65% Zr
f. 45% Be, 0% Ti, 55% Zr
g. 55% Be, 15% Ti, 30% Zr
h. 55% Be, 20% Ti, 25% Zr
i. 50% Be, 35% Ti, 15% Zr
j. 43% Be, 53% Ti, 4% Zr.

The FIGURE, which is a ternary composition phase diagram, depicts the glass-forming region of the invention. This region, which is designated by the polygon a–b–c–d–e–f–g–h–i–j–a, encompasses glass-forming compositions having high strength, low density and good ductility. Compositions falling within this region evidence specific strengths of at least about 33 $\times$ 10$^5$ cm. Outside this region, either the compositions do not easily form glassy alloys at convenient quench rates or the high specific strengths of the amorphous alloys of the invention are not generally obtained.

In general, the amorphous metal alloys of the invention evidence specific strengths of at least about 33 $\times$ 10$^5$cm, as indicated above. Many alloys of the invention evidence specific strengths of about 45 $\times$ 10$^5$ cm and higher. The alloys evidencing such high specific strengths tend to lie in beryllium-titanium-rich portions of the glass-forming region disclosed above and are accordingly preferred. Such alloys are encompassed by the polygon a–b–k–l–m–n–i–j–a depicted in the FIGURE. The corners of the polygon are given by the following compositions:

a. 40% Be, 58% Ti, 2% Zr
b. 35% Be, 57% Ti, 8% Zr
k. 35% Be, 50% Ti, 15% Zr
l. 40% Be, 35% Ti, 25% Zr
m. 45% Be, 25% Ti, 30% Zr
n. 50% Be, 25% Ti, 25% Zr
i. 50% Be, 35% Ti, 15% Zr
j. 43% Be, 53% Ti, 4% Zr.

Amorphous metal alloys evidencing substantial improvements in strength-to-weight ratios are represented by the formula $Be_{40}Ti_{60-x}Zr_x$, where "$x$" ranges from about 2 to 30 atom percent. Such alloys combine high specific strengths ranging from about 45 $\times$ 10$^5$ to 60 $\times$ 10$^5$ cm, ease of fabricability and high ductility, and accordingly are also preferred.

For low values of "$x$", that is, from about 2 to 10 atom percent, hardness values of about 684 to 759 kg/mm$^2$ and densities of about 3.8 to 4.2 g/cm$^3$ are obtained. While the hardness values are within the range of those of prior art amorphous alloys, the densities are considerably lower, by a factor of about 2. Since hardness is related to strength, it is evident that for low values of "$x$," a substantial improvement in the strength-to-weight ratio is realized. Accordingly, such compositions are especially preferred. For example, the composition $Be_{40}Ti_{50}Zr_{10}$ has a hardness of 735 kg/mm$^2$, a density of 4.15 g/cm$^2$ and a calculated specific strength of 55.4 $\times$ 10$^5$ cm.

For higher values of "$x$," the hardness remains substantially unchanged, while the density increases only to about 4.7 g/cm$^3$, still well below that of prior art amorphous alloys. Thus, high strength-to-weight ratios are retained for the entire range of compositions.

The amorphous metal alloys are formed by cooling a melt of the desired composition at a rate of at least about 10$^{5°}$ C/sec. The purity of all compositions is that found in normal commercial practice. A variety of techniques are available, as is now wellknown in the art, for fabricating splat-quenched foils and rapidquenched continuous ribbon, wire, sheet, powder, etc. Typically, a particular composition is selected, powders or granules of the requisite elements in the desired portions are melted and homogenized, and the molten alloy is rapidly quenched on a chill surface, such as a rotating cylinder. Due to the highly reactive nature of these compositions, it is preferred that the alloys be fabricated in an inert atmosphere or in a partial vacuum. Minor additions of up to about 2 atom percent of other metals and metalloids, such as aluminum and boron, may be made without appreciably diminishing the high strength-to-weight ratio of the alloys of the invention.

While amorphous metal alloys are defined earlier as being at least 50% amorphous, a higher degree of amorphousness yields a higher degree of ductility. Accordingly, amorphous metal alloys that are substantially amorphous, that is, at least 80% amorphous are preferred. Even more preferred are totally amorphous alloys. The degree of amorphousness is conveniently determined by X-ray diffraction.

Because of the strength of these alloys, based on the hardness data, and their low density, these alloys are useful in applications requiring high strength-to-weight ratio such as structural materials in aerospace applications and as fibers in composite materials. Further, the amorphous metal alloys in accordance with the invention evidence crystallization temperatures of over 400° C. Thus, they are suitable in applications involving moderate temperatures up to about 400° C.

EXAMPLES

An arc-splat unit for melting and liquid quenching high temperature reactive alloys was used. The unit, which was a conventional arc-melting button furnace modified to provide "hammer and anvil" splat quenching of alloys under inert atomsphere, included a vacuum chamber connected with a pumping system. The quenching was accomplished by providing a flat-surfaced water-cooled copper hearth on the floor of the chamber and a pneumatically driven copper-block hammer positioned above the molten alloy. As is conventional, arc-melting was accomplished by negatively biasing a copper shaft provided with a non-consumable tungsten tip inserted through the top of the chamber and by positively biasing the bottom of the chamber. All alloys were prepared directly by repeated arc-melting of constituent elements. A single alloy button (about 200 mg) was remelted and then "impact-quenched" into a foil about 0.004 inch thick by the hammer situated just above the molten pool. The cooling rate attained by this technique was at least about $10^{5°}$ C/sec.

Hardness (DPH) was measured by the diamond pyramid technique, using a Vickers-type indenter consisting of a diamond in the form of a square-based pyramid with an included angle of 136° between opposite faces. Loads of 50g and 100g were variously applied. The hardness values obtained at 50g were generally within 10% of those values obtained at 100g.

Crystallization temperature was measured by differential thermal analysis (DTA) at a scan rate of about 20° C/min. Typically, the amorphous metal alloys evidenced crystallization temperatures ranging from about 412° to 455° C.

Various alloys were prepared using the arc-splating apparatus described above. A non-reactive atmosphere of argon was employed. Amorphousness was determined by X-ray diffraction.

The compositions of the amorphous alloys of the invention, their observed hardness values (100g load) and densities and calculated specific strengths are listed in Table I below.

TABLE I.

AMORPHOUS ALLOYS WITHIN THE SCOPE OF THE INVENTION

| Composition, Atom percent | | | | | Hardness, | Density, | Specific Strength, |
|---|---|---|---|---|---|---|---|
| Be | Ti | Zr | Al | B | kg/mm² | g/cm³ | cm (calculated) |
| 55 | 20 | 25 | — | — | — | 4.43 | — |
| 55 | 15 | 30 | — | — | — | 4.58 | — |
| 50 | 35 | 15 | — | — | 759 | 4.17 | 56.7 |
| 50 | 25 | 25 | — | — | 780* | 4.46 | 54.6 |
| 50 | 10 | 40 | — | — | 649 | 4.91 | 41.3 |
| 45 | 40 | 15 | — | — | 657* | 4.14 | 49.6 |
| 45 | 15 | 40 | — | — | 668 | 4.78 | 43.6 |
| 45 | 10 | 45 | — | — | 644 | 5.14 | 39.2 |
| 45 | — | 55 | — | — | 644 | 5.4 | 37.2 |
| 44 | 48 | 8 | — | — | 785* | 4.06 | 60.5 |
| 43 | 53 | 4 | — | — | 740 | — | — |
| 42 | 50 | 8 | — | — | 692 | 4.05 | 53.4 |
| 42 | 48 | 10 | — | — | 673 | 4.16 | 50.6 |
| 41 | 49 | 10 | — | — | 706 | 4.13 | 53.4 |
| 40 | 58 | 2 | — | — | 717* | 3.94 | 56.8 |
| 40 | 56 | 4 | — | — | 759 | 3.98 | 59.5 |
| 40 | 54 | 6 | — | — | 694 | 4.09 | 53.0 |
| 40 | 52 | 8 | — | — | 684 | 4.15 | 51.5 |
| 40 | 50 | 10 | — | — | 735* | 4.15 | 55.4 |
| 40 | 45 | 15 | — | — | 673 | 4.37 | 48.2 |
| 40 | 40 | 20 | — | — | 680 | 4.50 | 47.2 |
| 40 | 30 | 30 | — | — | 656 | 4.73 | 43.4 |
| 40 | 20 | 40 | — | — | 678 | 4.95 | 42.8 |
| 40 | 15 | 45 | — | — | 615 | 5.06 | 38.0 |
| 40 | 10 | 50 | — | — | 615 | 5.3 | 36.3 |
| 40 | — | 60 | — | — | 579 | 5.4 | 33.5 |

TABLE I.-continued

AMORPHOUS ALLOYS WITHIN THE SCOPE OF THE INVENTION

| Composition, Atom percent | | | | | Hardness, | Density, | Specific Strength, |
|---|---|---|---|---|---|---|---|
| Be | Ti | Zr | Al | B | kg/mm² | g/cm³ | cm (calculated) |
| 40 | — | 58 | 2 | — | 653 | 5.34 | 38.2 |
| 40 | — | 58 | — | 2 | 786 | 5.39 | 45.6 |
| 40 | — | 58 | 1 | 1 | 670 | 5.40 | 38.8 |
| 35 | 55 | 10 | — | — | 634 | 4.25 | 46.5 |
| 35 | 20 | 45 | — | — | 674 | 5.22 | 40.4 |
| 35 | 15 | 50 | — | — | 611 | 5.27 | 36.2 |
| 35 | — | 65 | — | — | 642* | 5.41 | 37.1 |
| 30 | 50 | 20 | — | — | 629 | 4.59 | 42.8 |
| 30 | 30 | 40 | — | — | 611 | 5.13 | 37.2 |
| 30 | 20 | 50 | — | — | 549* | 5.25 | 32.7 |

*50g load

In addition, continuous ribbons of the above compositions were fabricated in vacuum employing quartz crucibles and extruding molten material onto a rapidly rotating quench wheel by overpressure of argon. A partial vacuum of about 200 μm of Hg was employed. The hardness values and densities of the ribbons agreed to within experimental error for splats of the same composition.

For comparison, the compositions of some amorphous alloys lying outside the scope of the invention and their hardness values, densities and calculated specific strengths are listed in Table II below. These alloys were either brittle and hence not substantially amorphous or, in general, evidenced unacceptably low specific strengths.

TABLE II.

ALLOYS OUTSIDE THE SCOPE OF THE INVENTION

| Composition, Atom percent | | | Hardness, | Density, | Specific Strength, |
|---|---|---|---|---|---|
| Be | Ti | Zr | kg/mm² | g/cm³ | cm (calculated) |
| 60 | 10 | 30 | brittle | 4.52 | — |
| 55 | 25 | 30 | " | — | — |
| 43 | 55 | 2 | " | — | — |
| 35 | 60 | 5 | " | — | — |
| 30 | 10 | 60 | 503 | 5.51 | 28.5 |
| 25 | 30 | 45 | 480 | 5.21 | 28.8 |
| 25 | 5 | 70 | 557 | 5.69 | 30.6 |
| 20 | 25 | 55 | 473 | 5.52 | 26.8 |
| 20 | 15 | 65 | 511* | 5.6 | 28.6 |

*50g load

What is claimed is:

1. A high strength, low density metal alloy that is substantially amorphous, characterized in that the alloy consists essentially of a composition being defined within an area on a ternary diagram having as its coordinates in atom percent Be, atom percent Ti, and atom percent Zr, said area being defined by a polygon having at its corners the 10 points defined by a. 40% Be, 58% Ti, 2% Zr
b. 35% Be, 57% Ti, 8% Zr
c. 30% Be, 55% Ti, 15% Zr
d. 30% Be, 20% Ti, 50% Zr
e. 35% Be, 0% Ti, 65% Zr
f. 45% Be, 0% Ti, 55% Zr
g. 55% Be, 15% Ti, 30% Zr
h. 55% Be, 20% Ti, 25% Zr
i. 50% Be, 35% Ti, 15% Zr
j. 43% Be, 53% Ti, 4% Zr.

2. The amorphous alloy of claim 1 in which the alloy consists essentially of a composition being defined within an area on said ternary diagram, said area being defined by a polygon having at its corners the eight points defined by a. 40% Be, 58% Ti, 2% Zr
b. 35% Be, 57% Ti, 8% Zr
k. 35% Be, 50% Ti, 15% Zr
l. 40% Be, 35% Ti, 25% Zr
m. 45% Be, 25% Ti, 30% Zr
n. 50% Be, 25% Ti, 25% Zr
i. 50% Be, 35% Ti, 15% Zr
j. 43% Be, 53% Ti, 4% Zr.

3. The amorphous alloy of claim 1 in which the alloy is represented by the formula $Be_{40}Ti_{60-x}Zr_x$, where "$x$" ranges from about 2 to 30 atom percent.

4. The amorphous alloy of claim 3 in which "$x$" ranges from about 2 to 10 atom percent.

5. The amorphous alloy of claim 4 having the composition $Be_{40}Ti_{50}Zr_{10}$.

* * * * *